US007140215B2

(12) United States Patent
Viviroli et al.

(10) Patent No.: US 7,140,215 B2
(45) Date of Patent: Nov. 28, 2006

(54) CUTTING HEAD FOR WIRE-PROCESSING MACHINE

(75) Inventors: Stefan Viviroli, Horw (CH); Daniel Fischer, Lucerne (CH)

(73) Assignee: Komax Holding AG, Dierikon (CH)

( * ) Notice: Subject to any disclaimer, the term of this patent is extended or adjusted under 35 U.S.C. 154(b) by 183 days.

(21) Appl. No.: 10/937,979

(22) Filed: Sep. 9, 2004

(65) Prior Publication Data

US 2005/0050932 A1 Mar. 10, 2005

(30) Foreign Application Priority Data

Sep. 10, 2003 (EP) ..... 03405664

(51) Int. Cl.
*B21D 37/00* (2006.01)
*H01R 43/00* (2006.01)

(52) U.S. Cl. ..... 72/19.6; 72/17.1; 72/18.6; 72/18.9; 72/19.5; 72/20.1; 72/21.4; 29/593; 29/753; 29/863

(58) Field of Classification Search ..... 72/19.6, 72/20.1, 17.1, 18.9, 18.6, 19.5, 21.4; 29/564.4, 29/33 M, 564.1, 564.5, 564.6, 739, 705, 753, 29/593, 863; 81/9.51
See application file for complete search history.

(56) References Cited

U.S. PATENT DOCUMENTS 4,951,369 A * 8/1990 Verrall ..... 29/33 M
5,025,549 A * 6/1991 Hornung et al. ..... 29/564.4
5,058,260 A * 10/1991 Gloe et al. ..... 29/564.4
5,092,026 A * 3/1992 Klemmer et al. ..... 29/593
5,271,254 A * 12/1993 Gloe et al. ..... 72/13.2
5,491,994 A * 2/1996 Baldyga ..... 72/20.1
5,522,130 A * 6/1996 Wollermann ..... 29/825
5,526,717 A * 6/1996 Koch ..... 81/9.51
5,797,299 A * 8/1998 Long, Jr. ..... 81/9.51
5,887,469 A * 3/1999 Maeda et al. ..... 72/20.1
5,921,125 A 7/1999 Inoue et al.
5,937,505 A * 8/1999 Strong et al. ..... 29/593
6,212,924 B1 * 4/2001 Meisser ..... 72/21.4
6,418,768 B1 * 7/2002 Meisser et al. ..... 72/20.1
6,418,769 B1 * 7/2002 Schreiner ..... 72/21.4
6,487,885 B1 * 12/2002 Meisser et al. ..... 72/20.1
6,910,256 B1 * 6/2005 Locher et al. ..... 29/564.4
2005/0050722 A1 * 3/2005 Viviroli ..... 29/729

FOREIGN PATENT DOCUMENTS

EP 0 623 982 11/1994
WO WO 9717751 A1 * 5/1997

* cited by examiner

*Primary Examiner*—Dmitry Suhol
(74) *Attorney, Agent, or Firm*—Butzel Long

(57) ABSTRACT

A cutting head has upper part with at least one separating cutter, at least one stripping cutter, a first cutting edge, a force-measuring device operating on the piezo principle, and a first holding plate. A lower part of the cutting head includes at least one separating cutter, at least one stripping cutter, a second cutting edge and a second holding plate. The first cutting edge, the second cutting edge, and the force-measuring device serve to measure the height of the crimp. The first holding plate and the second holding plate serve to measure the pull-out force.

8 Claims, 5 Drawing Sheets

CUTTING HEAD FOR WIRE-PROCESSING MACHINE

BACKGROUND OF THE INVENTION

The present invention relates to a cutting head for a wire-processing machine comprising an upper part with at least one cutter, and a lower part with at least one cutter, and a drive which drives the upper part and the lower part.

The European patent application EP 0 623 982 B1 shows a wire-cutting machine with a cutting. By means of the cutting head, wires are cut off using cutting blades and stripping blades and then stripped of insulation. For this purpose a cutter drive is provided above the wire line which moves the cutter by means of a toothed rack. After cutting off the wire, the insulation of the wire-ends is cut into and then pulled off by means of pulling-off drives.

A disadvantage of the known device is the space requirement of the drives in the cutting-head area. Furthermore, measurements have to be made on the wire outside the machine.

SUMMARY OF THE INVENTION

The present invention concerns a cutting head for a wire-processing machine comprising: an upper part having at least one cutter; a lower part having at least one cutter; a drive linearly driving the upper part and the lower part relative to one another; and measuring devices for measuring functions of a wire-processing operation performed by the upper part and the lower part, the measuring functions being executable by linear actuation movement of the upper part and the lower part. The advantages achieved by the present invention are essentially that besides wire cutting and wire stripping, other operations for processing wires can be performed. For example, with the cutting head according to the present invention, the height of the crimp contact in the area of the wire crimp can be measured. Further, with the cutting head according to the present invention it is possible, for example, to measure the force needed to pull the wire out of the crimp contact. The extended functions of the cutting head allow shorter overall processing times, since the auxiliary functions hitherto performed outside the wire-processing machine are obviated. Measurement of the pull-out force can, for example, be performed by means of the current of the motor that executes the linear movement of the wire gripper. To measure the crimp height, for example, only a force-measuring device with piezo elements is needed, the crimp height being determinable from the increase in force of the piezo elements and the positions of the halves of the cutting head.

The measurement data normally captured when setting up, and sometimes during production, can be saved and used further for quality assurance.

The cutting head according to the present invention can be used in wire-processing machines with linear wire-feeding or in wire-processing machines with swivel-arm feeding.

Besides the cutting functions such as cutting-off or stripping of insulation, the cutting head according to the present invention can also perform non-cutting functions such as, for example, measuring the crimp height or measuring the pull-out force. The cutting head is linearly actuated and requires only one drive, the low-level arrangement of the drive facilitating access to other modules of the wire-processing machine.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
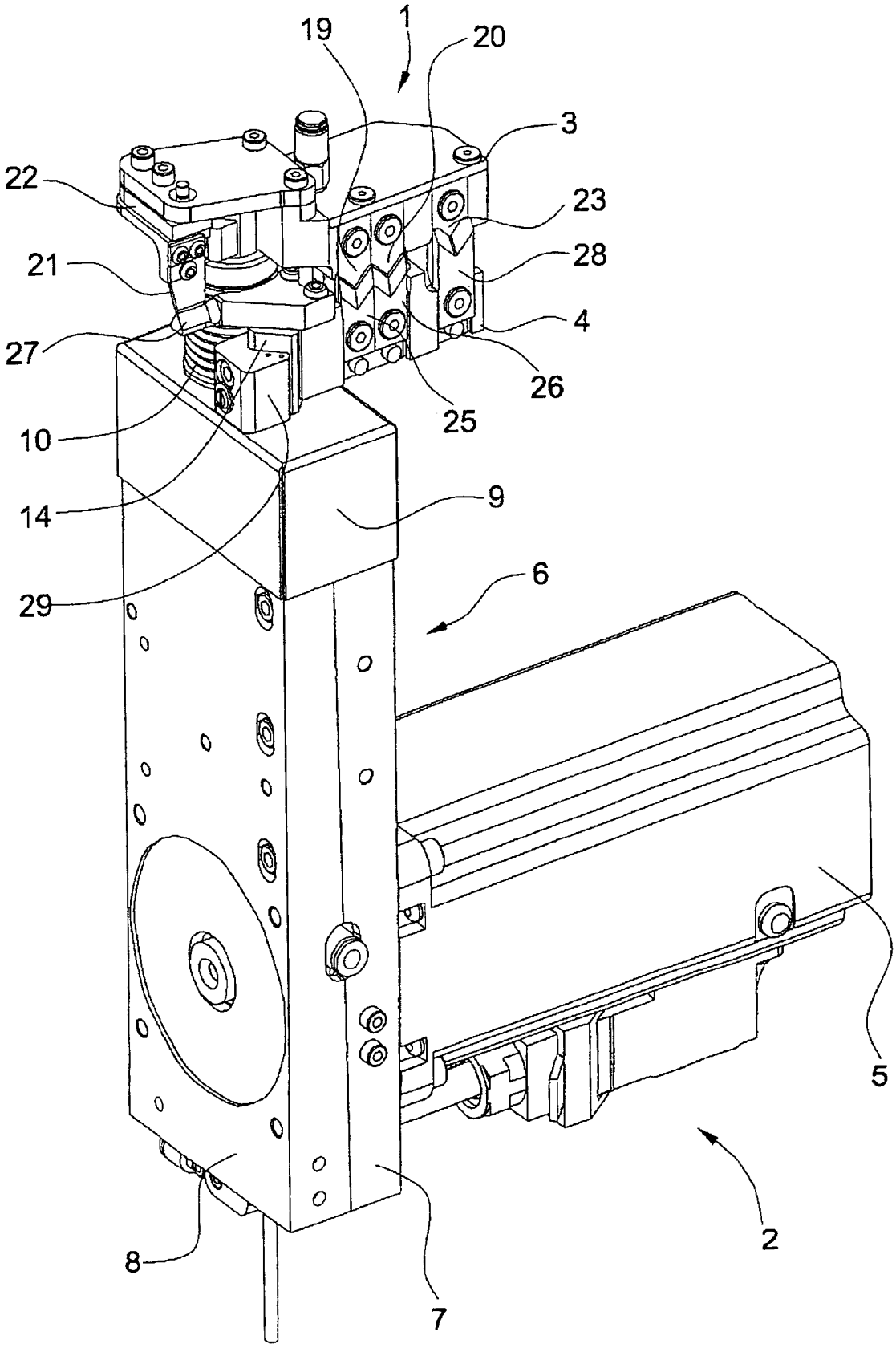
FIG. 1 a perspective view of a cutting head with a drive according to the present invention.

FIG. 1 shows the cutting head 1 according to the invention with a drive 2. The cutting head 1 includes an upper part 3 and a lower part 4, which are linearly movable. The linear motion is generated by means of the drive 2, the rotational motion of a motor 5 being converted into a linear motion of the upper/lower part 3, 4. A linear unit 6 is accommodated in a housing 7 with a cover 8. The linear unit 6 is protected from remnants of insulation and remnants of wire by means of a movable cap 9 and by means of a folding bellows 10.

Figure 2:
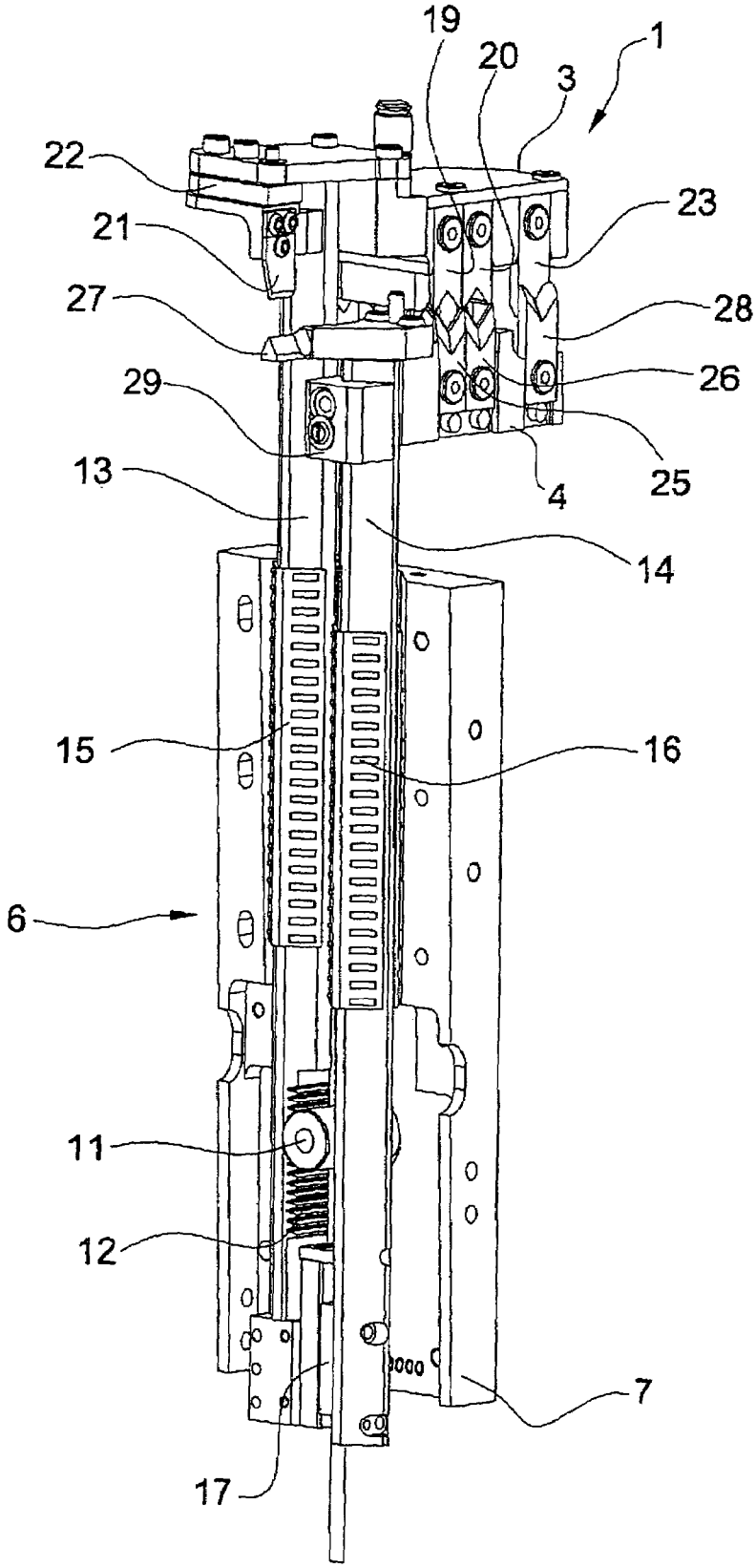
FIG. 2 is a perspective view of the drive shown in FIG. 1 with an opened housing.

FIG. 2 shows the drive 2 with the housing 7 opened exposing the details of the linear unit 6. The rotational motion of the motor 5 is transferred to a pinion 11 that is engaged with a first rack 12 and a not-visible similar second rack. The first rack 12 is part of a first arm 13, the second rack is part of a second arm 14. By means of the pinion 11, the racks and associated arms 13, 14 are moved in opposite directions. The first arm 13, which is triangular in cross-section, is guided by means of a first linear guide 15 arranged on the housing 7. The second arm 14, which is triangular in cross-section, is guided by means of a second linear guide 16 arranged on the housing 7. The upper part 3 of the cutting head 1 is connected to the first arm 13. The lower part 4 of the cutting head 1 is connected to the second arm 14. The position of the first arm 13 and the position of the second arm 14 are detected by means of a position measuring device 17 that generates a position signal representing the detected positions. For example, by means of an optic sensor that scans a glass rule, the glass rule executing the movement of one of the arms 13, 14. The measuring device 17 can also operate on the principle of magnetism or capacitance.

Figure 3:
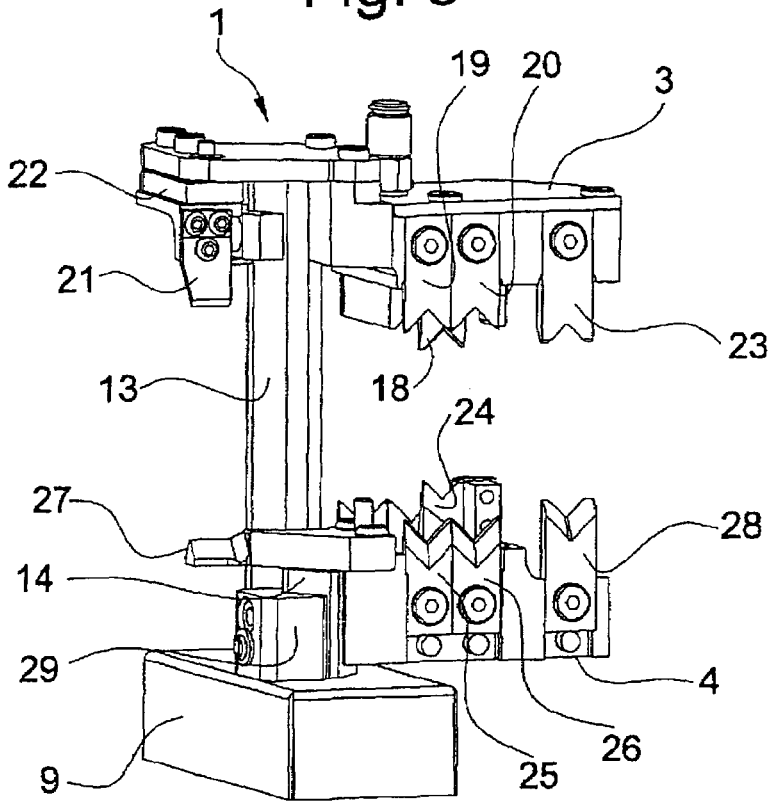
FIG. 3 is an enlarged perspective view of the cutting head shown in FIG. 1 in an opened position.
Figure 4:
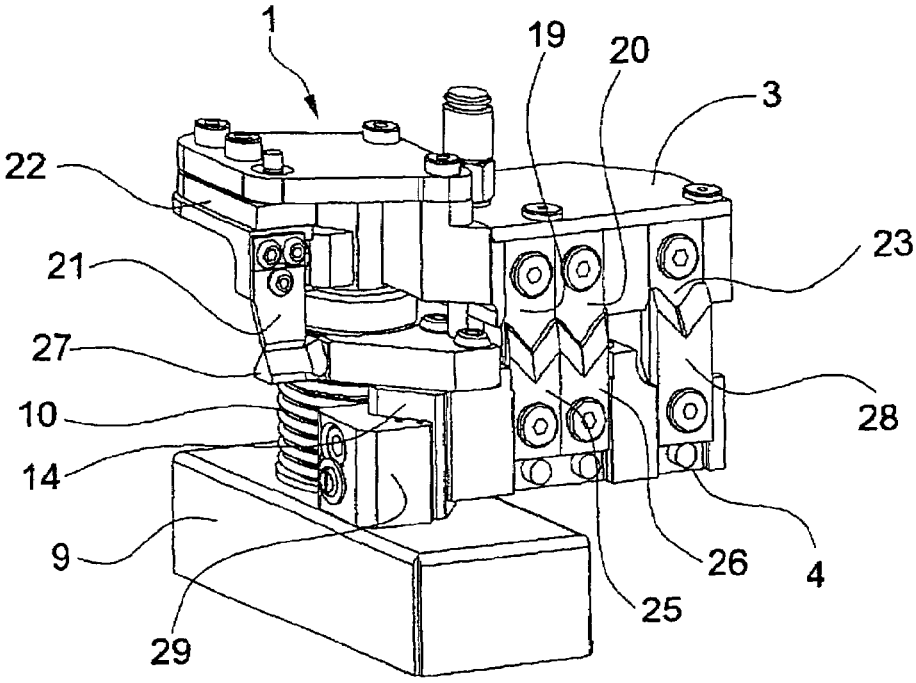
FIG. 4 is a view similar to FIG. 3 of the cutting head in a closed position.

FIG. 3 shows the cutting head 1 in an opened position and FIG. 4 shows the cutting head 1 in a closed position. The upper part 3 of the cutting head 1 consists of at least one separating cutter 18, a first stripping cutter 19, a second stripping cutter 20, a first cutting edge 21, a force-measuring device 22 operating on the piezo principle, and a first holding plate 23. The lower part 4 of the cutting head 1 consists of at least one separating cutter 24, a third stripping cutter 25, a fourth stripping cutter 26, a second cutting edge 27, and a second holding plate 28. The cap 9 is arranged on a clamp 29 connected to the second arm 14. The cap 9 is moved up and down with the second arm 14, the first arm 13 passing through the cap 9. The folding bellows 10 enclose the passage through the cap 9. The first cutting edge 21, the second cutting edge 27, and the force-measuring device 22 serve to measure the crimp height. The first holding plate 23 and second holding plate 28 serve to measure the pull-out force. Remnants of insulation fall into a bunker 34 shown in FIG. 7.

Figure 5:
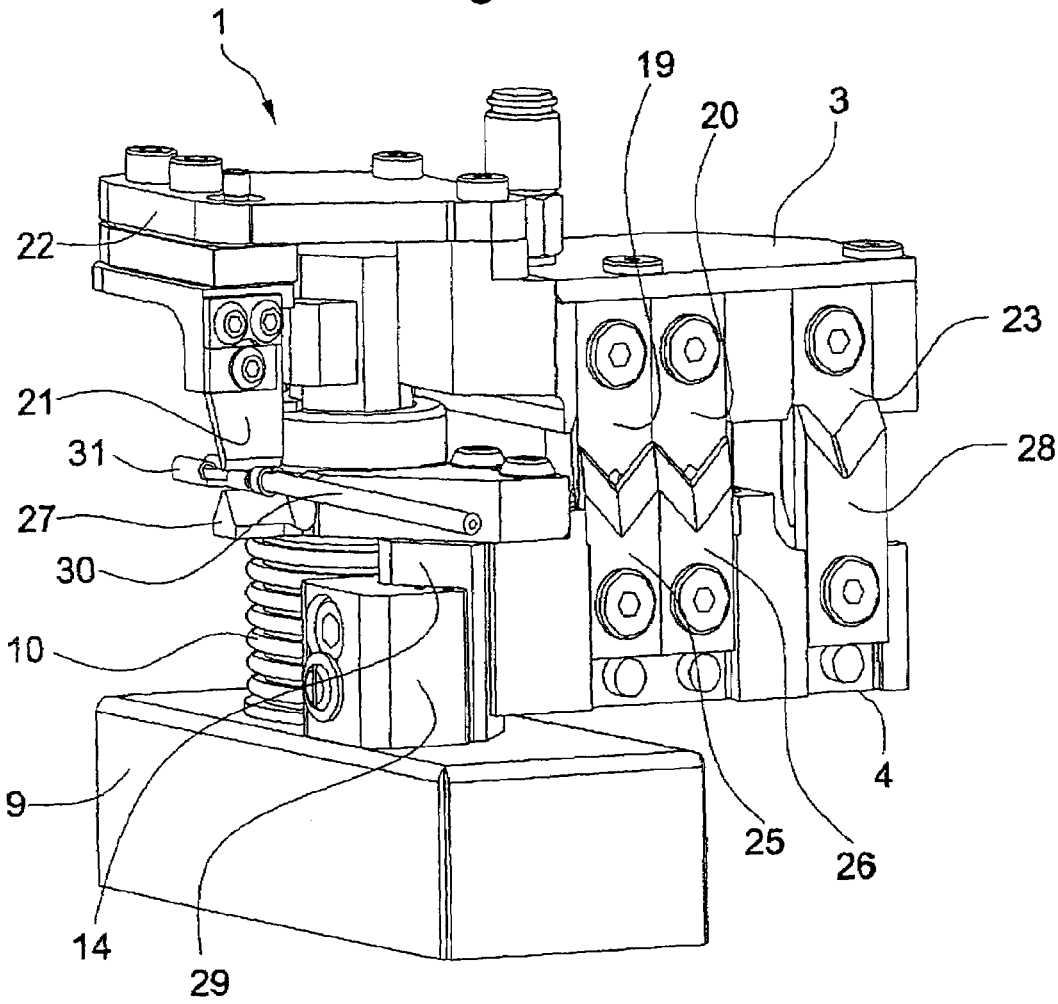
FIG. 5 is an enlarged view similar to FIG. 4 with the cutting head measuring a crimp height.
Figure 6:
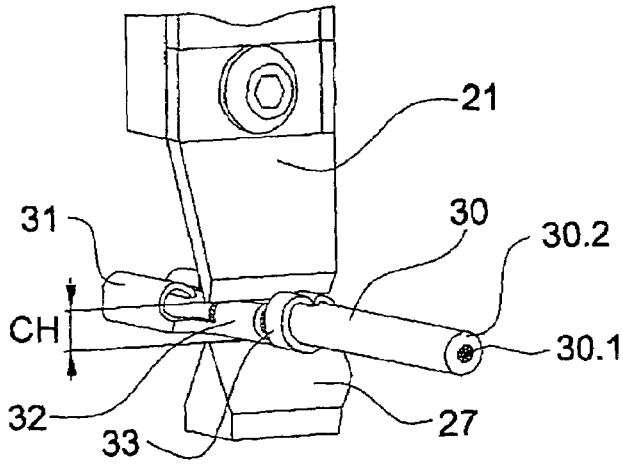
FIG. 6 is an enlarged fragmentary view of the crimp height measuring portion of the cutting head shown in FIG. 5.

FIG. 5 and FIG. 6 show the cutting head 1 when measuring a crimp height. In the position shown in FIG. 4, the force-measuring device 22 is initialized to zero and the positions of the first arm 13 and of the second arm 14 are detected by means of the measuring device 17. The cutting head 1 is then opened and a wire 30 comprising a conducting core 30.1 and an insulating layer 30.2 with crimp contact 31 is laid between the first cutting edge 21 and the second cutting edge 27. The cutting head 1 is then actuated until the force-measuring device 22 detects an increase in force, which increase is generated as a force signal that triggers a new detection of the momentary positions of the first arm 13 and the second arm 14. The difference between the two positions gives a crimp height CH. As shown in FIG. 6, the crimp height CH relates to a wire crimp 32 of the crimp contact 31. For measuring the crimp height, an insulation crimp 33 of the crimp contact 31 is of secondary importance. The cutting head 1 is so designed that it can be served with leading-end and trailing-end wire-ends from the front, as shown, as well as the back.

Figure 7:
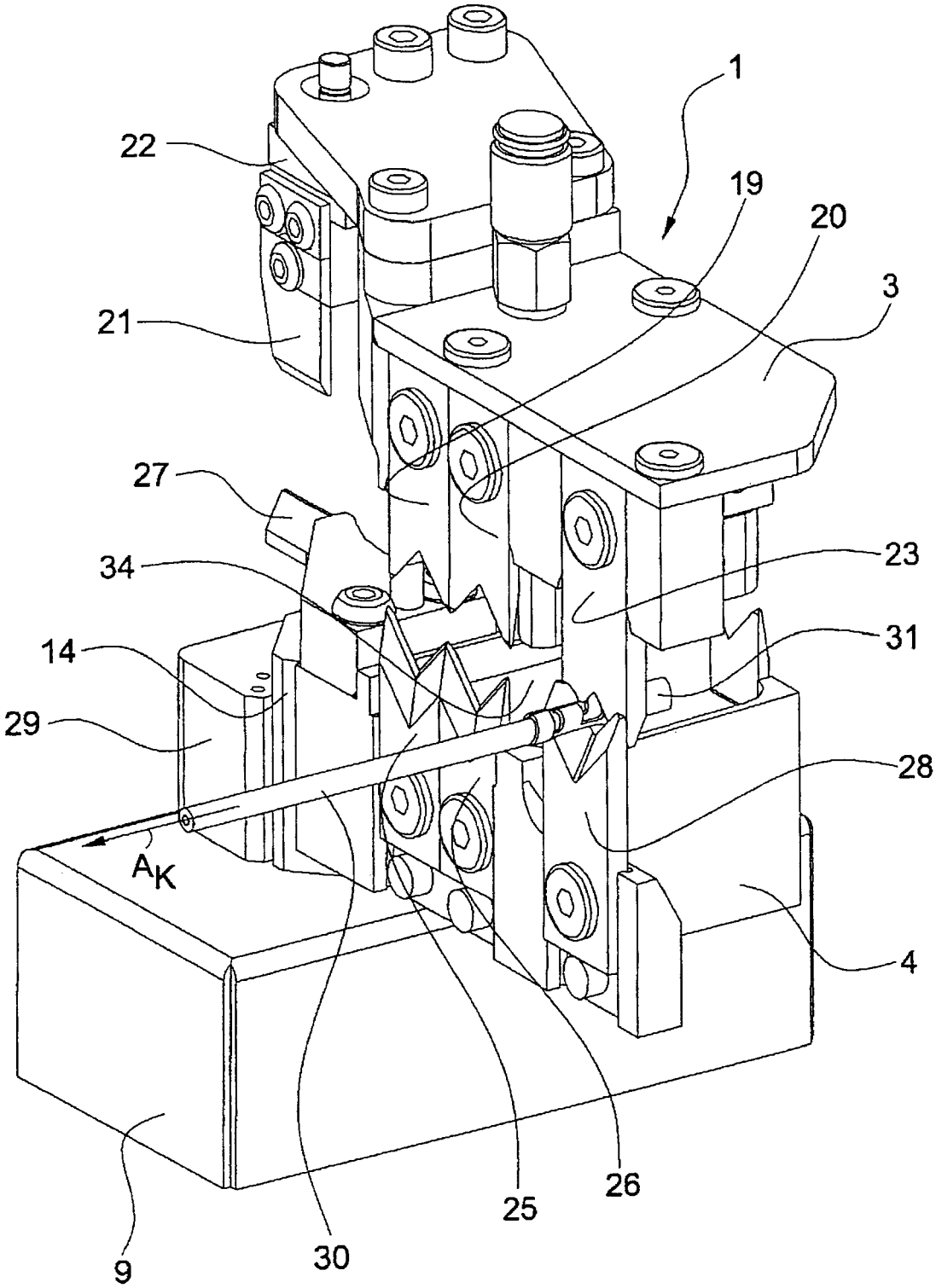
FIG. 7 is a perspective view of the cutting head shown in FIG. 1 measuring a pull-out force.

FIG. 7 shows the cutting head 1 measuring a pull-out force for which the first holding plate 23 and the second holding plate 28 hold the crimp contact 31 firmly. The gripper bringing the wire 30 with the crimp contact 31 executes a linear movement with limited current. The limit current corresponds to a pull-out force AK in a direction of an arrow. Failure to attain the pull-out force AK or the limit current means that the crimp connection has not withstood the required pull-out force AK because the wire crimp 32 and/or the insulating crimp 33 is defective.

In a further exemplary embodiment, the cutting head 1 has no stripping cutter 19, 20, 25, 26. Provided that it is allowed by the wire 30, the conductor insulation 30.2 can be cut into by means of the separating cutters 18, 24 (the V-shaped cutters cut into the insulation at four points) and the remnant of the insulation is pulled off.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A cutting head for a wire-processing machine comprising:

an upper part having at least one cutter;

a lower part having at least one cutter;

a drive linearly driving said upper part and said lower part relative to one another; and measuring devices for measuring functions of a wire-processing operation performed by said upper part and said lower part, said measuring functions being executable by linear actuation movement of said upper part and said lower part, wherein said measuring devices include a device for measuring a crimp height of a wire crimp of a crimp contact on a wire being processed, said device for measuring a crimp height including a force-measuring device and a first cutting edge on said upper part and a second cutting edge on said lower part, whereby when the crimp contact is arranged between said first and second cutting edges and said drive moves said upper part and said lower part toward one another, an increase in force is sensed by said force-measuring device.

2. The cutting head according to claim 1 including a position measuring device detecting a position of said upper part and a position of said lower part and generating a position signal representing the detected positions, and wherein said force-measuring device generates a force signal whereby the crimp height of the crimp contact can be determined.

3. The cutting head according to claim 1 wherein said measuring devices include a device for measuring a pull-out force of a wire from an attached crimp contact.

4. The cutting head according to claim 3 wherein said upper part includes a first holding plate and said lower part includes a second holding plate, said drive moving said upper part and said lower part to hold between said holding plates a crimp contact for measurement of the pull-out force.

5. A cutting head for a wire-processing machine comprising:

an upper part having a first cutter;

a lower part having a second cutter;

a drive linearly driving said upper part and said lower part relative to one another; and a crimp height measuring device for measuring a crimp height of a wire crimp of a crimp contact on a wire being processed wherein said crimp height measuring device includes a force-measuring device and a first cutting edge on said upper part and a second cutting edge on said lower part, whereby when the crimp contact is arranged between said first and second cutting edges and said drive moves said upper part and said lower part toward one another, an increase in force is sensed by said force-measuring device.

6. The cutting head according to claim 5 including a position measuring device detecting a position of said upper part and a position of said lower part and generating a position signal representing the detected positions, and wherein said force-measuring device generates a force signal whereby the crimp height of the crimp contact can be determined.

7. A cutting head for a wire-processing machine comprising:

an upper part having a first cutter;

a lower part having a second cutter;

a drive linearly driving said upper part and said lower part relative to one another; and a pull-out force measuring device for measuring a pull-out force required to remove a crimp contact from a wire being processed.

8. The cutting head according to claim 7 wherein said upper part includes a first holding plate and said lower part includes a second holding plate, said drive moving said upper part and said lower part to hold between said holding plates a crimp contact for measurement of the pull-out force.

* * * * *